US008443576B2

(12) United States Patent
Petta

(10) Patent No.: US 8,443,576 B2
(45) Date of Patent: May 21, 2013

(54) POST CASING

(75) Inventor: Gabriel Petta, Woodbridge (CA)

(73) Assignee: Alpa Lumber Inc., Mississauga (CA)

( * ) Notice: Subject to any disclaimer, the term of this patent is extended or adjusted under 35 U.S.C. 154(b) by 42 days.

(21) Appl. No.: 13/166,043

(22) Filed: Jun. 22, 2011

(65) Prior Publication Data

US 2012/0324826 A1 Dec. 27, 2012

(51) Int. Cl.
*E04C 3/00* (2006.01)

(52) U.S. Cl.
USPC ..... 52/835; 52/579; 52/588.1; 52/843; 52/844; 52/845

(58) Field of Classification Search
USPC ..... 52/578.1, 588.1, 579, 835, 836, 843–845
See application file for complete search history.

(56) References Cited

U.S. PATENT DOCUMENTS

| | | | | |
|---|---|---|---|---|
| 5,647,186 | A | 7/1997 | Donaldson | |
| 5,956,290 | A | 9/1999 | Matsuzaki | |
| 5,956,920 | A * | 9/1999 | Davis | 52/844 |
| 6,412,250 | B2 * | 7/2002 | Davis | 52/834 |
| 6,918,221 | B2 | 7/2005 | Williams | |
| D521,656 | S * | 5/2006 | Terrels | D25/122 |
| 7,168,220 | B2 * | 1/2007 | Owoc et al. | 52/844 |
| 7,243,473 | B2 * | 7/2007 | Terrels | 52/843 |
| 7,621,080 | B2 * | 11/2009 | Stanfield | 52/170 |
| 7,866,120 | B2 * | 1/2011 | Prenn | 52/835 |
| 8,074,424 | B2 * | 12/2011 | Waters et al. | 52/834 |
| 2001/0022056 | A1 * | 9/2001 | Gifford | 52/311.1 |
| 2002/0017072 | A1 * | 2/2002 | Davis | 52/736.3 |
| 2003/0145555 | A1 * | 8/2003 | Raskin et al. | 52/731.3 |

FOREIGN PATENT DOCUMENTS

| | | |
|---|---|---|
| CA | 2238453 | 2/1999 |
| CA | 2326252 | 3/2001 |
| CA | 2300565 | 1/2004 |

* cited by examiner

*Primary Examiner* — Mark Wendell
(74) *Attorney, Agent, or Firm* — Bereskin & Parr LLP/S.E.N.C.R.L.,s.r.l.

(57) ABSTRACT

A casing member for assembly with an opposed identical casing member to encase a post includes an elongate body portion having spaced apart first and second side edges extending lengthwise of the body portion. First and second connectors are adjacent the first and second side edges respectively, and extend lengthwise therealong. The first connector includes a first tongue protruding from the body portion along a tongue axis. The second connector includes a groove bounded at least partially by spaced apart first and groove second sidewalls joined to the body portion. The first groove has a groove axis parallel to both the groove sidewalls and the tongue axis. The first tongue is inter-engageable with the first groove of the opposed identical casing member and the first groove is inter-engageable with the first tongue of the opposed casing member so as to secure the two casing members together about the post.

16 Claims, 7 Drawing Sheets

POST CASING

FIELD

The teaching disclosed herein related to one or more methods or apparatuses for encasing a post or column.

INTRODUCTION

The following is not an admission that anything discussed below is prior art or part of the common general knowledge of persons skilled in the art.

U.S. Pat. No. 5,956,290 discloses an elongate modular post cladding element for being assembled with a plurality of like elements to cover a post. The cladding element includes a panel for being applied to one side of the post, and having first and second opposed end edges and first and second opposed, longitudinally extending side edges. A female fastener extends along the first side edge of the panel. A complementary male fastener extends along the opposed second side edge of the panel, and is adapted for cooperating with a female fastener of a like, adjacent cladding element for locking the two cladding elements together on the post.

Canadian Patent No. 2,326,252 (Davis) discloses an elongate modular post cladding element adapted for cooperating with at least one other cladding element to cover a post. The cladding element includes a panel for being applied to the post, and having first and second opposed end edges and first and second opposed, longitudinally-extending side edges. A female fastener extends along the first side edge of the panel. A complementary male fastener extends along the opposed second side edge of the panel. The female fastener has spaced-apart surfaces forming a generally U-shaped groove having a depth at least twice as great as its width. The groove defines a position adjustment zone for receiving a selected portion of a male fastener of an adjacent cladding element to adjustably position the adjacent cladding element on the post. A retaining assembly may be provided for securing a flexible sheet material to the panel.

Canadian Patent No. 2,238,453 (Davis) discloses an elongate modular post cladding element for being assembled with a plurality of like elements to cover a post. The cladding element includes a panel for being applied to one side of the post, and having first and second opposed end edges and first and second opposed, longitudinally-extending side edges. A female fastener extending along the first side edge of the panel. A complementary male fastener extends along the opposed second side edge of the panel, and is adapted for cooperating with a female fastener of a like, adjacent cladding element for locking the cladding elements together on the post.

SUMMARY

The following summary is provided to introduce the reader to the more detailed discussion to follow. The summary is not intended to limit or define the claims.

According to one aspect, there is a casing member for assembly with an opposed identical casing member to encase a post. The casing member comprises an elongate body portion having a first side edge and a second side edge spaced apart from the first side edge. Each side edge extends lengthwise of the body portion. The casing member also comprises a first connector adjacent the first side edge of the body portion and extending lengthwise therealong. The first connector includes a first tongue protruding from the body portion along a tongue axis. The casing member also comprises a second connector adjacent the second side edge of the body portion and extending lengthwise therealong. The second connector includes a first groove bounded at least partially by spaced apart first groove first and second sidewalls joined to the body portion. The first groove has a groove axis parallel to the groove sidewalls. The tongue axis and the groove axis are parallel to each other. The first tongue is inter-engageable with the first groove of the opposed identical casing member and the first groove is inter-engageable with the first tongue of the opposed casing member so as to secure the two casing members together about the post.

The casing member may have a generally constant cross-sectional profile along its length. The body portion, the first connector, and the second connector may be collectively of integral, unitary, extruded construction.

The body portion may comprise an inner body wall and an outer body wall overlying and spaced apart from the inner body wall. Each of the inner and outer body walls extends laterally between the first and second connectors. The inner body wall and outer body wall are joined together by a plurality of spaced apart webs.

The first connector may comprise a second tongue parallel to and adjacent the first tongue. Furthermore, the second connector may comprise a second groove parallel to and adjacent the first groove. The second tongue is inter-engageable with the second groove of the opposed casing member and the second groove is inter-engageable with the second tongue of the opposed casing member. The second groove may be positioned laterally outboard of the first groove, and the second tongue may be positioned laterally outboard of the first tongue.

The body portion may be generally L-shaped in cross-section, and may have a first planar panel and a second planar panel connected together along a longitudinally extending corner joint. Alternatively, the body portion may be generally semi-circular in cross-section.

According to another aspect, a column assembly comprises a post having a lower post end for bearing against a support surface, an upper post end for bearing against a load surface, and a post length extending between the upper and lower post ends. The column assembly also comprises a first elongate casing member adjacent a first side of the post and extending along the post length, and a second elongate casing member adjacent a second side of the post generally opposite the first side and extending along the post length. The second elongate casing member is joined to the first casing member to generally encase the post.

The first and second casing members are substantially identical extruded members. Each casing member has a first connector that extends lengthwise along a first side of each casing member and that comprises at least a first tongue. Furthermore, each casing member has a second connector that extends lengthwise along a second side of each casing member and that comprises at least a first groove. The first tongue of the first casing member is inter-engaged with the first groove of the second casing member and the first tongue of the second casing member is inter-engaged with the first groove of the first casing member to securely join together the first and second casing members.

Each of the first and second casing members may be formed of respective substantially identical first and second extruded lineals. The first tongue and first groove may be an integral, unitary portion of each one of the first and second extruded lineals.

The first tongues of each of the first and second casing members may protrude from the respective first sides in a direction parallel to an engagement axis.

The assembly may be free of any attachment between the casing members and the post along the post length between the lower post end and the upper post end. An inner surface of each casing member may be spaced apart from an outer surface of the post.

According to another aspect, a kit of parts for casing a post comprises a first elongate casing member and a second elongate casing member for assembly with the first casing member to generally encase the post. The first and second casing members are substantially identical. Each casing member has a first connector that extends lengthwise along a first side of each casing member and that comprises at least a first tongue. Furthermore, each casing member has a second connector that extends lengthwise along a second side of each casing member and that comprises at least a first groove. The first tongue of the first casing member is inter-engageable with the first groove of the second casing member and the first tongue of the second casing member is inter-engageable with the first groove of the first casing member to securely join together the first and second casing members.

Each casing member may have a generally constant cross-sectional profile along its length. The body portion, the first connector, and the second connector of each casing member may be collectively of integral, unitary, extruded construction.

The body portion of each casing member may comprise an inner body wall and an outer body wall overlying and spaced apart from the inner body wall. Each of the inner and outer body walls extends laterally between the first and second connectors. The inner body wall and outer body wall are joined together by a plurality of spaced apart webs.

The first connector of each casing member may comprise a second tongue parallel to and adjacent the first tongue. Furthermore, the second connector of each casing member may comprise a second groove parallel to and adjacent the first groove. The second tongue of the first casing member is inter-engageable with the second groove of the second casing member and the second groove of the first casing member is inter-engageable with the second tongue of the second casing member. The second groove of each casing member may be positioned laterally outboard of the first groove, and the second tongue of each casing member may be positioned laterally outboard of the first tongue.

DRAWINGS

Reference is made in the detailed description to the accompanying drawings, in which.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any invention disclosed in an apparatus or process described below and for which an exclusive right is not granted by issuance of this patent application may be the subject matter of another protective instrument, for example, a continuing patent application, and the applicants, inventors or owners do not intend to abandon, disclaim or dedicate to the public any such invention by its disclosure in this document.

Figure 1:
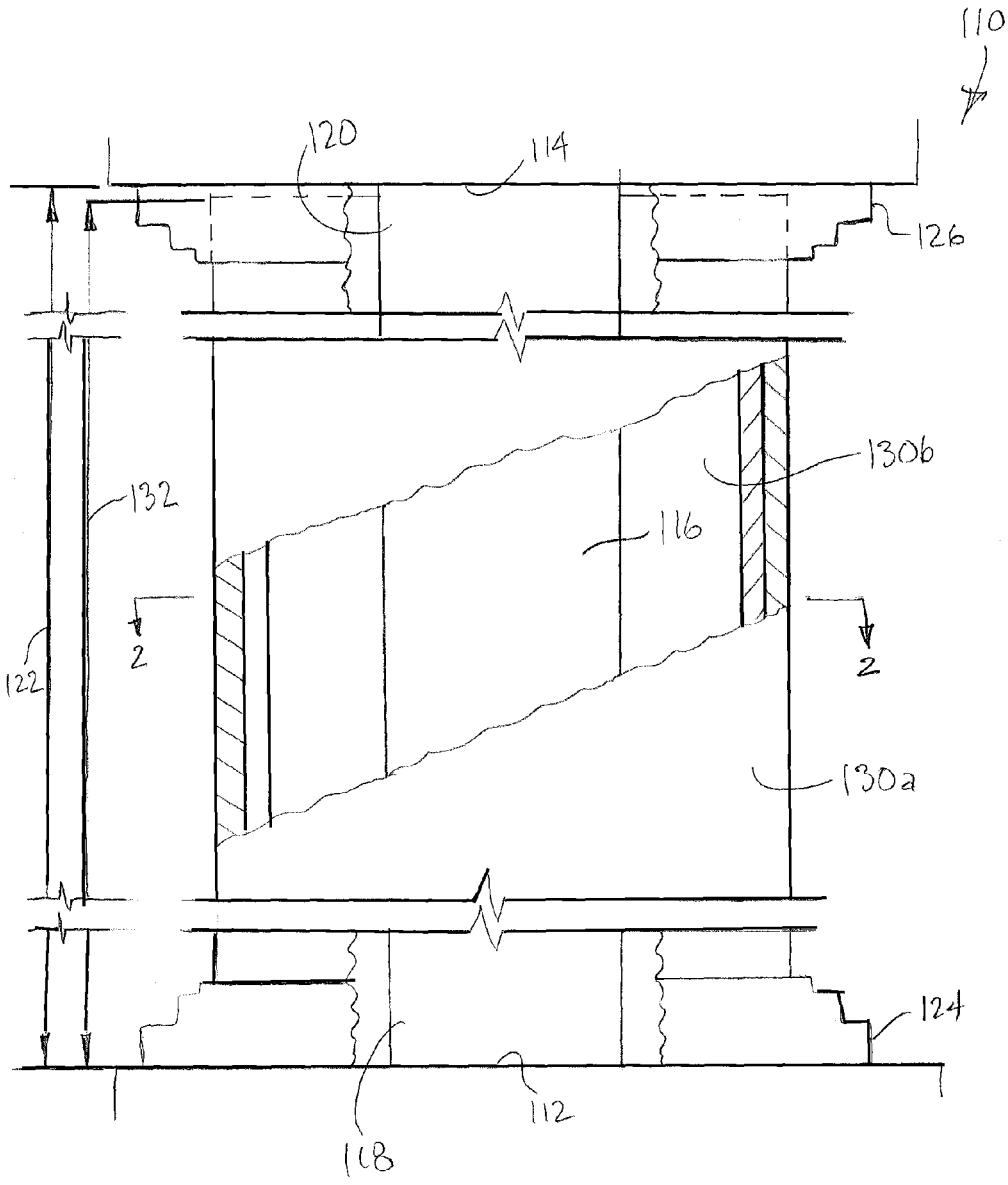
FIG. 1 is a side elevation view of a column assembly including a post encased along its length by casing members.
Figure 2:
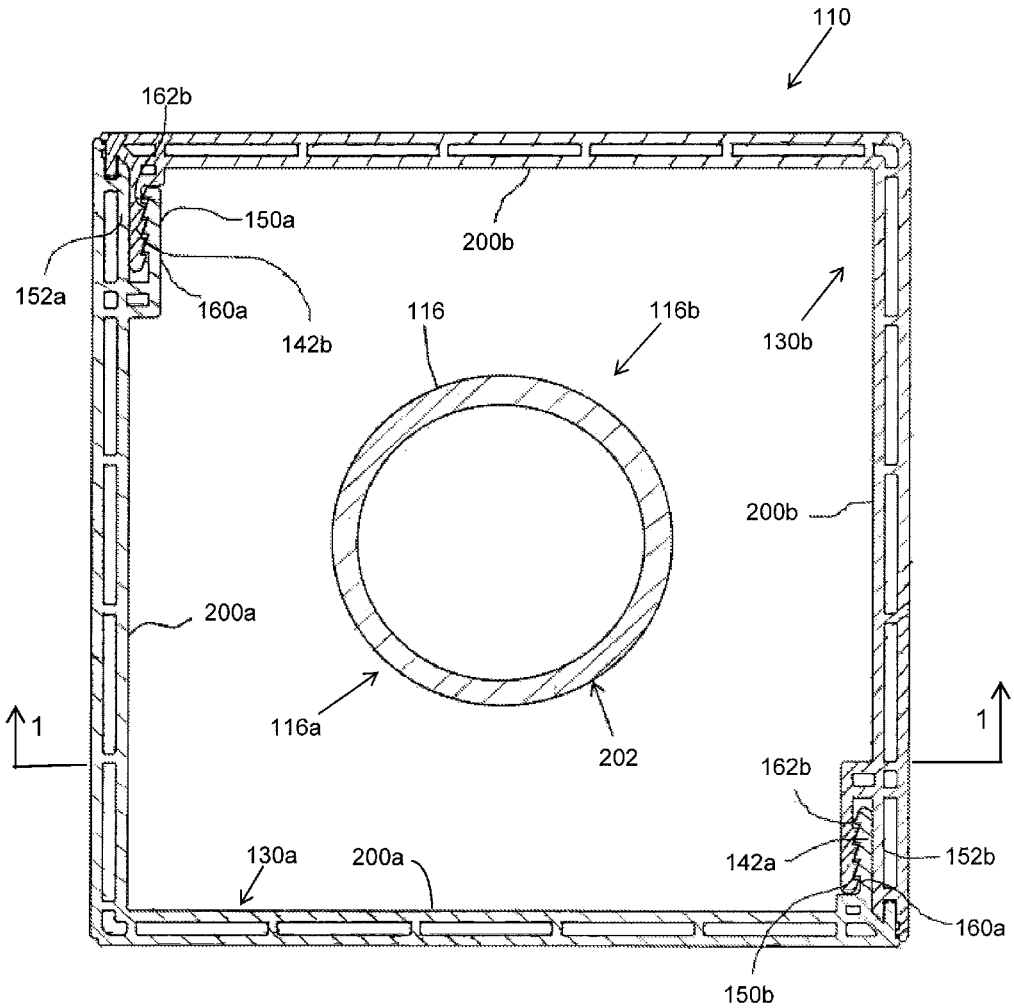
FIG. 2 is a cross-sectional view of the column assembly of FIG. 1 along the line 2-2, wherein the casing members are in an assembled position.

Referring to FIGS. 1 to 2, a column assembly 110 is shown positioned vertically between a support surface 112 and a load surface 114 spaced vertically above the support surface 112. The support surface 112 may, for example, be an upper surface of a concrete pad or porch and the load surface 114 may, for example, be an underside surface of an overhead roof structure or portico.

The column assembly 110 comprises a post 116 having a lower post end 118 for bearing against the support surface 112, and an upper post end 120 for bearing against the load surface 114. The post 116 has a post length 122 that extends between opposed end faces of the upper and lower post ends 118, 120. The post 116 can comprise a structural load bearing member, such as, for example, a wooden "4 by 4" or a pair of "2 by 4's" positioned side-by-side and having a length corresponding to the post length 122. In the example illustrated, the post 116 comprises a steel post having a circular cross-section (as shown in FIG. 2) with a diameter of about 6 cm and a post length 122 of about 2.5 m.

The column assembly 110 further includes casing for generally encasing the post 116 along its length 122. In the example illustrated, the casing includes a first elongate casing member 130*a* adjacent a first side 116*a* of the post 116 (for example, defined by one half of the semi-circular post) and a second elongate casing member 130*b* adjacent a second side 116*b* of the post 116 (for example, defined by the other half of the semi-circular post) and in opposed relation to the first casing member 130*a*.

The first and second casing members 130*a*, 130*b* extend lengthwise along the post length 122, and have respective casing lengths 132 that generally correspond to the post length 122. For example, the casing lengths 132 may be substantially equal to the post length 122, or one or more of the casing members 130*a*, 130*b* may be slightly shorter than the post length 122 as shown in FIG. 1.

The lateral position of the casing members 130*a*, 130*b* may be fixed in place relative to the support surface 112 and/or the load surface 114. For example, in the illustrated example, a lower mount 124 located adjacent the lower post end 118 fixes the position of the casing members 130*a*, 130*b* relative to the support surface 112, and an upper mount 126 adjacent the upper post end 120 fixes the position of the casing members 130*a*, 130*b* relative to the load surface 114. The mounts 124, 126 can be vertically aligned to position the ends of the casing members 130*a*, 130*b* so that the casing members 130*a*, 130*b* are plumb, for example, even if the post 116 is off plumb.

The casing members 130*a*. 130*b* may be supplied individually, or as a kit of parts for encasing the post 116. While the illustrated example shows two casing members 130*a*, 130*b* for encasing the post, in other examples the casing may include more than two casing members.

The first and second casing members 130*a*, 130*b* are, in the example illustrated, substantially identical extruded members and a single one of the casing members 130*a*, 130*b* is generically referred to as casing member 130.

Figure 4:
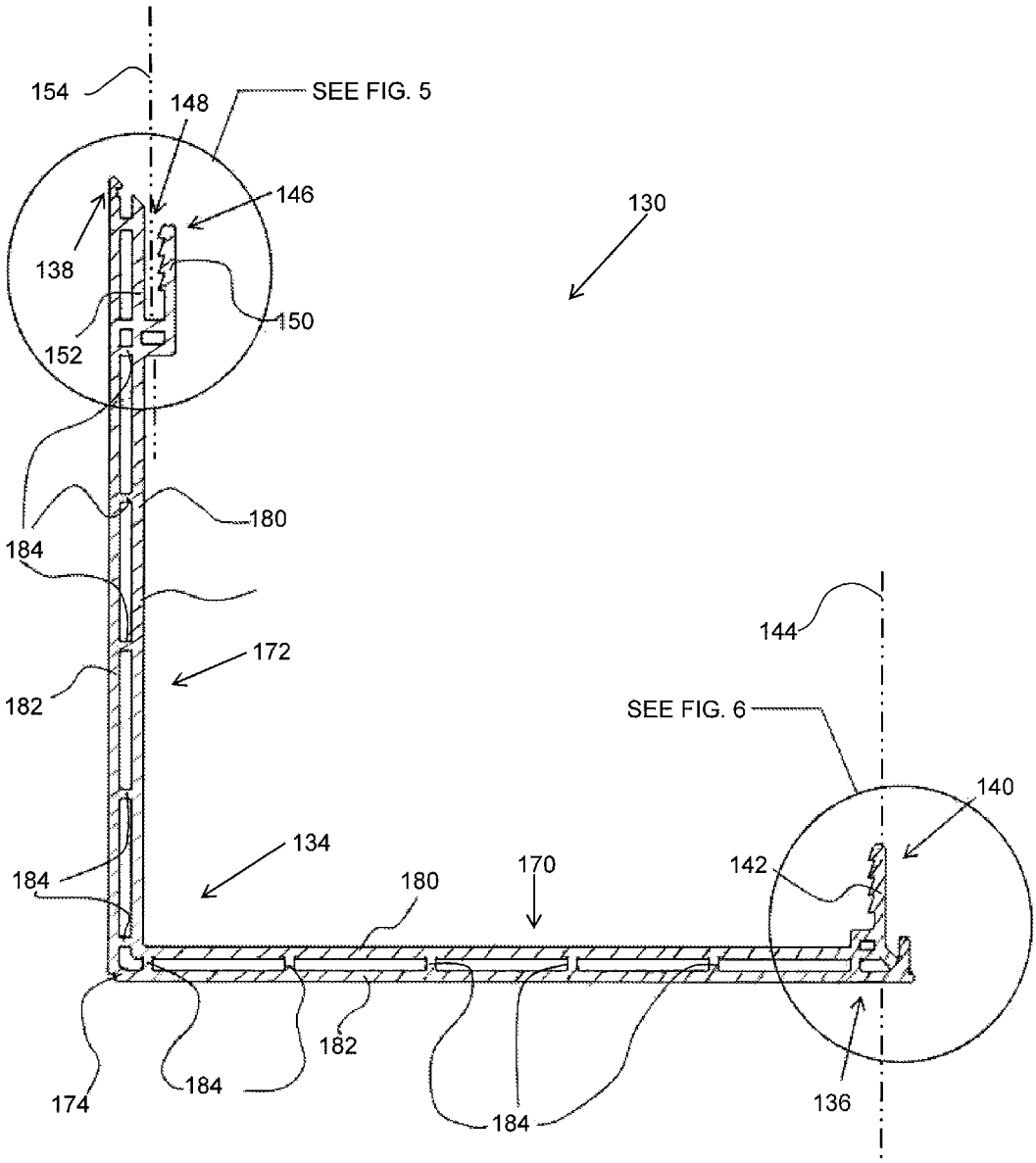
FIG. 4 is an end view of one of the casing members.

With reference also to FIG. 4, the casing member 130 includes an elongate body portion 134 extending along the casing length 132. The elongate body portion 134 may have a cross-sectional shape such as, for example, semi-circular, planar, or generally U-shaped. In the example illustrated, the body portion 134 is generally L-shaped in cross-section and has a first planar panel 170 and a second planar panel 172. The planar panels 170, 172 are, in the example illustrated, connected together (at respective proximal edges) along a longitudinally extending corner joint 174.

The body portion 130 has a first side edge 136 and a second side edge 138 spaced apart from the first side edge 136. In the illustrated example, the first side edge 136 is located at a distal edge of the first planar panel 170, and the second side edge 138 is located at a distal edge of the second planar panel 172. Each side edge 136, 138 extends lengthwise along the body portion 134 (i.e. in the example illustrated, for the entire casing length 132). The body portion 134 extends laterally (orthogonally to the lengthwise direction) between the first and second side edges 136, 138.

The casing member 130 also includes connectors for securing the casing members together so as to encase the post 116. In particular, the casing member 130 includes a first connector 140 adjacent the first side edge 136 of the body portion 134 and extending lengthwise therealong. In the example illustrated, the first connector 140 includes a first tongue 142 protruding from the body portion 134 along a tongue axis 144. In the illustrated example, the tongue axis extends generally orthogonal to the first planar panel 170.

The casing member 130 also includes a second connector 146 adjacent the second side edge 138 of the body portion 134 and extending lengthwise therealong. In the example illustrated, the second connector 146 includes a first groove 148. The first groove 148 is bounded at least partially by a first groove first sidewall 150 that is spaced apart from a first groove second sidewall 152. The first groove sidewalls 150, 152 are, in the example illustrated, generally parallel to each other. The first groove 148 has a groove axis 154 that is parallel to the first groove sidewalls 150, 152 and to the tongue axis 144.

The first tongue 142 of the casing member 130 is inter-engageable with the first groove of an opposed identical casing member, and the first groove 148 of the casing member 130 is inter-engageable with the first tongue of the opposed identical casing member. This allows the casing members to be secured together, for example, to encase the post 116.

Figure 3:
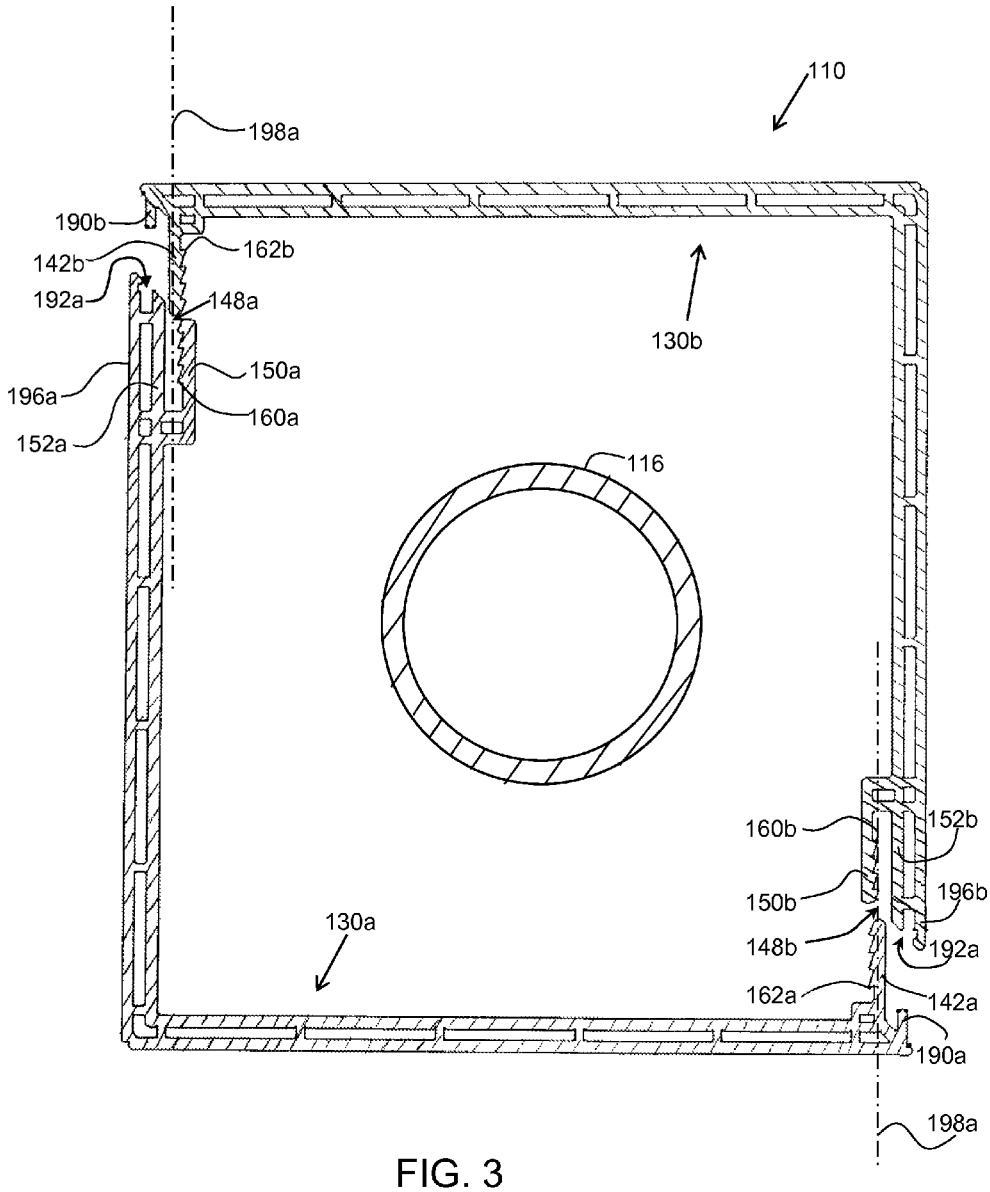
FIG. 3 is a cross-sectional view of the column assembly, wherein the casing members are in an unassembled position.

More specifically, with reference to FIGS. 2 and 3, the first and second casing members 130*a*, 130*b* are movable from a non-secured (or unassembled) position, shown in FIG. 3, to a secured (or assembled) position, shown in FIG. 2.

In the non-secured position (shown in FIG. 3), the first connector 140*a* of the first casing member 130*a* is not engaged with the second connector 146*b* of the second casing member 130*b*, and the second connector 146*a* of the first casing member 130*a* is not engaged with the first connector 140*b* of the second casing member 130*b*. In preparation for assembly, the first tongue 142*a* of the first casing member 130*a* may be aligned with the first groove 148*b* of the second casing member 130*b* along a first engagement axis 198*a*, and the first groove 148*a* of the first casing member 130*a* may be aligned with the first tongue 142*b* of the second casing member 130*b* along a second engagement axis 198*b*. The tongues 142*a*, 142*b* can inter-engage the corresponding grooves 148*a*, 148*b* by drawing the casing members 130*a*, 130*b* together along the engagement axes 198*a*, 198*b*.

In the secured position (shown in FIG. 2), the first connector 140*a* of the first casing member 130*a* is fully engaged with the second connector 146*b* of the second casing member 130*b* and the second connector 146*a* of the first casing member 130*a* is fully engaged with the first connector 140*b* of the second casing member 130*b*. More particularly, the first tongue 142*a* of the first connector 140*a* of the first casing member 130*a* is inter-engaged with the first groove 148*b* of the second connector 146*b* of the second casing member 130*b*. Similarly, the first groove 148*a* of the second connector 146*a* of the first casing member 130*a* is inter-engaged with the first tongue 142*b* of the first connector 140*b* of the second casing member 130*b*. The inter-engagement of the connectors 140*a*, 146*b* and 140*a*, 146*b* secures the casing members 130*a*, 130*b* together about the post 116 and can provide a solid connection that increases the rigidity of the casing.

As shown in the example illustrated, the casing member 130 may have a generally constant cross-sectional profile along its length. Furthermore, the first connector 140, the second connector 146, and the body portion 134 may collectively be of integral, unitary, extruded construction. The casing member 130 may be formed of a plastic extruded lineal.

In some examples, the body portion 134 may be formed from two or more pieces that are secured together. For example, the first and second planar panels 170, 172 may be separate pieces that can be secured together along the corner joint 174, for example, using connectors, which may be similar to the connectors 140 and 146.

Figure 5:
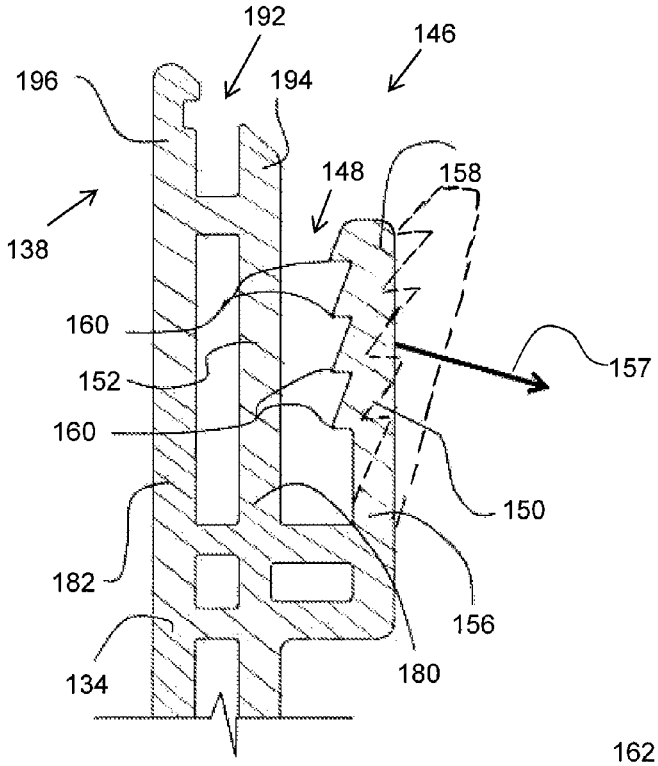
FIG. 5 is an enlarged view of a second connector of the casing member of FIG. 4.

With reference to FIG. 5, the first groove first sidewall 150 has a base end 156 joined to the body portion 134, and a free end 158 spaced apart from the base end 156. The first groove first sidewall 150 may be provided with at least one barb 160 projecting towards the first groove second sidewall 152. In the example illustrated, the first groove first sidewall 150 includes a plurality of barbs 160 (e.g. four barbs) in the form of groove teeth.

Figure 6:
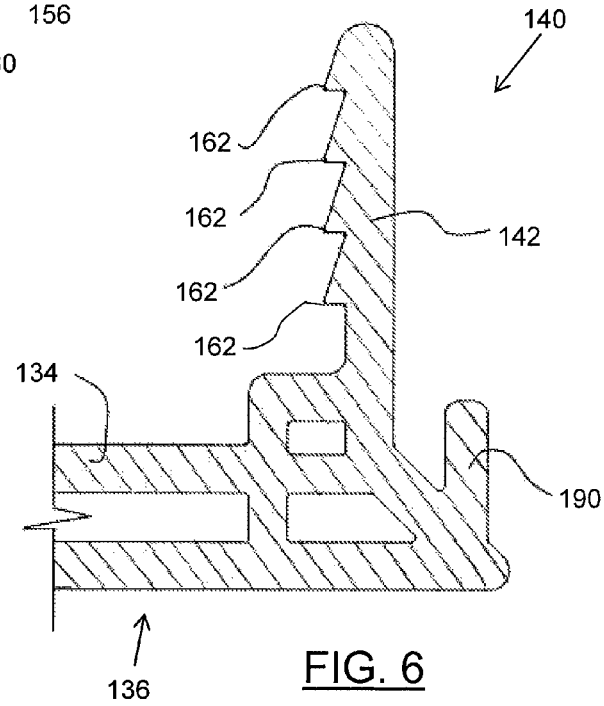
FIG. 6 is an enlarged view of a first connector of the casing member of FIG. 4.

Referring to the first connector 140 shown in FIG. 6, the tongue 142 may be provided with at least one catch 162 for interlocking with the barb of an opposed casing member when the two casing members are secured together. In the example illustrated, the tongue 142 includes a plurality of catches 162 (e.g. four catches) in the form of tongue teeth.

The barbs 160 generally interlock with catches of an opposing casing member so as to securely assemble the two casing members together. For example, with reference to the joint shown at the top left of FIG. 2, the barbs 160*a* of the first groove first sidewall 150*a* of the first casing member 130*a* are interlocked with the catches 162*b* of the tongue 142*b* of the second casing member 130*b*. Similarly, with reference to the joint shown at the bottom right of FIG. 2, the barbs 162*b* of the first groove first sidewall 150*b* of the second casing member 130*b* are interlocked with the catches 160*a* of the tongue 142*a* of the first casing member 130*a*.

With reference to FIG. 5, the first groove first sidewall 150 may be resiliently bendable about a pivot axis, which may be defined by the integral connection joint between the base end 156 and the elongate body portion 134. This bending or pivoting may allow the first groove first sidewall 150 to deflect open in a direction 157 away from the first groove second sidewall 152, for example, as the catches 162 are pushed past the barbs of an opposing casing member.

The first groove first sidewall 150 is, in the example illustrated, biased towards its as-extruded position (shown in solid lines in FIG. 5) by an internal biasing force, urging the material to remain in its as-extruded shape and position. The biasing force urges the first groove first sidewall 150 back towards the first groove second sidewall 152 when the barbs and catches are interlaced with each other. When the first groove first sidewall 150 returns to its as-extruded position, the catches 162 may securely engage and interlock with the barbs of the opposing casing member, inhibiting withdrawal of the first tongue from the groove.

In the example illustrated, the first groove first sidewall 150 is positioned laterally inwardly of the first groove second sidewall 152, and the first groove first sidewall 150 deflects laterally inward. Accordingly, after installation of the casing members 130, the first groove first sidewall 150 is located internal to the assembled column and is generally inaccessible. Unsecuring the casing members 130*a*, 130*b* would generally require urging the sidewall 150 to the open position. Locating the sidewall 150 internal to the column assembly renders this extremely difficult, or in some cases, impossible. This can guard against unwanted disassembly of the casing members 130*a*, 130*b*, for example, accidental opening of the tongue member (upon being caught or bumped, for example) or deliberate opening as may occur in the case of theft. In the example illustrated, the first and second connectors 140, 146 of the casing members 130*a*, 130*b* irremovably secure together the casing members 130*a*, 130*b*. Once assembled, removal of the casing members 130*a*, 130*b* from the column assembly generally requires cutting, breaking, or other irreparable destruction of the casing members 130*a*, 130*b* after which they cannot be re-secured together to encase the post.

Referring again to FIG. 4, in the example illustrated, the body portion 134 of the casing member 130 is of dual-walled construction. In particular, the body portion 134 includes an inner body wall 180 and an outer body wall 182 that overlies, and is spaced apart from, the inner body wall 180. The spacing between the inner and outer walls is generally uniform, and maintained by a plurality of webs 184 that extend between, and join together, the inner and outer body walls 180, 182.

Each of the inner and outer body walls 180, 182 generally extends laterally from one of the first and second connectors 140, 146 to the other of the first and second connectors 140, 146. In the example illustrated, the inner body wall 180 and outer body wall 182 (when viewed in cross section) each extend laterally between, and generally terminate at, the first side edge 136 and the second side edge 138. In the illustrated example, the first groove second wall 152 includes a portion of the inner body wall 180 of the body portion 134.

In the example illustrated, the dual-walled construction extends lengthwise along the entire casing length 132. The dual-walled structure can help increase the rigidity of the casing member 130, which can provide a more rigid casing assembly and/or a more secure connection between the casing members. For example, without the dual-walled construction it might be possible to bend the casing members 130 around the connectors 140, 146 (e.g. by applying a lateral force to one of the planar panels 170, 172). This bending may cause the catches 162 to disengage from the barbs 160, which may result in full or partial separation of the casing members 130*a*, 130*b*. The dual-walled construction can inhibit such bending of the casing members, and can provide a more secure connection.

The dual-walled structure might also improve the rigidity of the casing assembly such that the assembled casing members 130*a*, 130*b* can present a generally free-standing or self-supporting structure. This may be particularly beneficially when the casing members are spaced apart from the post 116 and are not supported thereby or connected thereto.

Referring again to FIG. 6, the first connector 140 may include a second tongue 190 parallel to and adjacent the first tongue 142. In the illustrated example, the second tongue 190 is positioned laterally outboard of the first tongue 142 (i.e. further from the post 116 when in the assembled state).

Furthermore, referring again to FIG. 5, the second connector 146 may include a second groove 192 parallel to and adjacent the first groove 148. In the illustrated example, the second groove 192 is positioned laterally outboard of the first groove 148 (i.e. further from the post 116 when in the assembled state). As shown, the second groove 192 is bounded at least partially by a second groove first sidewall 194 and a second groove second sidewall 196. In the illustrated example, the second groove first sidewall 194 includes a portion of the inner body wall 180 of the body portion 134, and the second groove second sidewall 196 includes an edge portion of the outer body wall 182 of the body portion 134. Furthermore, the second groove first sidewall 194 includes a portion of the first groove second sidewall 152.

The second tongue 190 is inter-engagable with the second groove of an opposed casing member, and the second groove 192 is inter-engageable with the second tongue of the opposed casing member. The second tongue 190 and the second groove 192 cooperate with the first tongue 142 and first groove 148 to provide a dual interlocking connection, which may further enhance the connection between the casing members. For example, the dual interlocking connection may further inhibit bending of the casing members 130 around the connectors 140, 146, which might otherwise allow the casing members 130 to separate by disengaging the catches 162 from the barbs 160 as described above.

Furthermore, positioning the second groove 192 and second tongue 190 outboard of the first groove 148 and the first tongue 142 might help to increase the inaccessibility of the bendable first groove first sidewall 150. This can help to provide a connection in which the casing members 130 are irremovably secured together.

In use, the post 116 of the column apparatus may generally be installed at around the same time that the structure (e.g. roof or portico) providing the load surface 114 is built. At a convenient time afterwards, the first and second casing members 130*a*, 130*b* can be installed to encase and conceal the post 116.

Referring to FIG. 3, to install the casing members 130*a*, 130*b*, the first and second casing members 130*a*, 130*b* can be positioned in opposing relation about the post 116, with the first and second tongues 142*a*, 190*a* of the first casing member 130*a* directed towards the first and second grooves 148*b*, 192*b* of the second casing member 130*b* and the first and second tongues 142*b*, 190*b* of the second casing member 130*b* directed towards the first and second grooves 148*a*, 192*a* of the first casing member 130*a*. With the respective tongue and groove axes aligned, the two casing members 130*a*, 130*b* can be drawn together along corresponding engagement axes 198*a*, 198*b*, thereby urging the tongues 142*a*, 142*b*, 190*a*, 190*b* into the respective grooves 148*a*, 148*b*, 192*a*, 192*b*. As the catches 162*a*, 162*b* of the tongues 142*a*, 142*b* are urged past the barbs 160*a*, 160*b* of the first groove first sidewalls 150*a*, 150*b*, the first groove first sidewalls 150*a*, 150*b* resiliently deflect (by bending about the base ends 156*a*, 156*b*) in a direction away from the second groove sidewalls 152*a*, 152*b*. When the catches 162*a*, 162*b* are seated behind the barbs 160*a*, 160*b*, the first groove first sidewalls 150*a*, 150*b* are urged (by an internal biasing force urging the sidewall to return to its as-extruded position)

towards the first groove second sidewalls 152*a*, 152*b*. The interlocked barbs 160*a*, 160*b* and catches 162*a*, 162*b* cooperate to inhibit withdrawal of the tongues 142*a*, 142*b* from the grooves 148*a*, 148*b*.

As described above, providing the deflecting member (i.e. the first groove first sidewall 150) internal to the assembled column assembly can help to inhibit subsequent disassembly of the two casing members.

In the example illustrated, the column assembly 110 is free of any attachment between the casing members 130*a*, 130*b* and the post 116 along the post length 122 between the lower post end 118 and the upper post end 120. More particularly, as shown in FIG. 2, an inner surface 200 of each casing member 130*a*, 130*b* is spaced apart from an outer surface 202 of the post 116, and these surfaces 200, 202 are free of any supports, braces or other attachments extending between and/or joining together the surfaces 200, 202. The secure connection provided between the casing members 130*a*, 130*b*, and the rigid construction of each casing member 130*a*, 130*b* can help to eliminate the need for internal bracing between the casing members and the post. The absence of such bracing can greatly simplify the assembly, and increase the "universal" application of the casing to encase, for example, posts 116 having a variety of shapes and sizes. The absence of internal bracing can also allow correction for improper positioning of a post (the casing can be installed off-center relative to the post, or off-plumb relative to the post).

Figure 7:
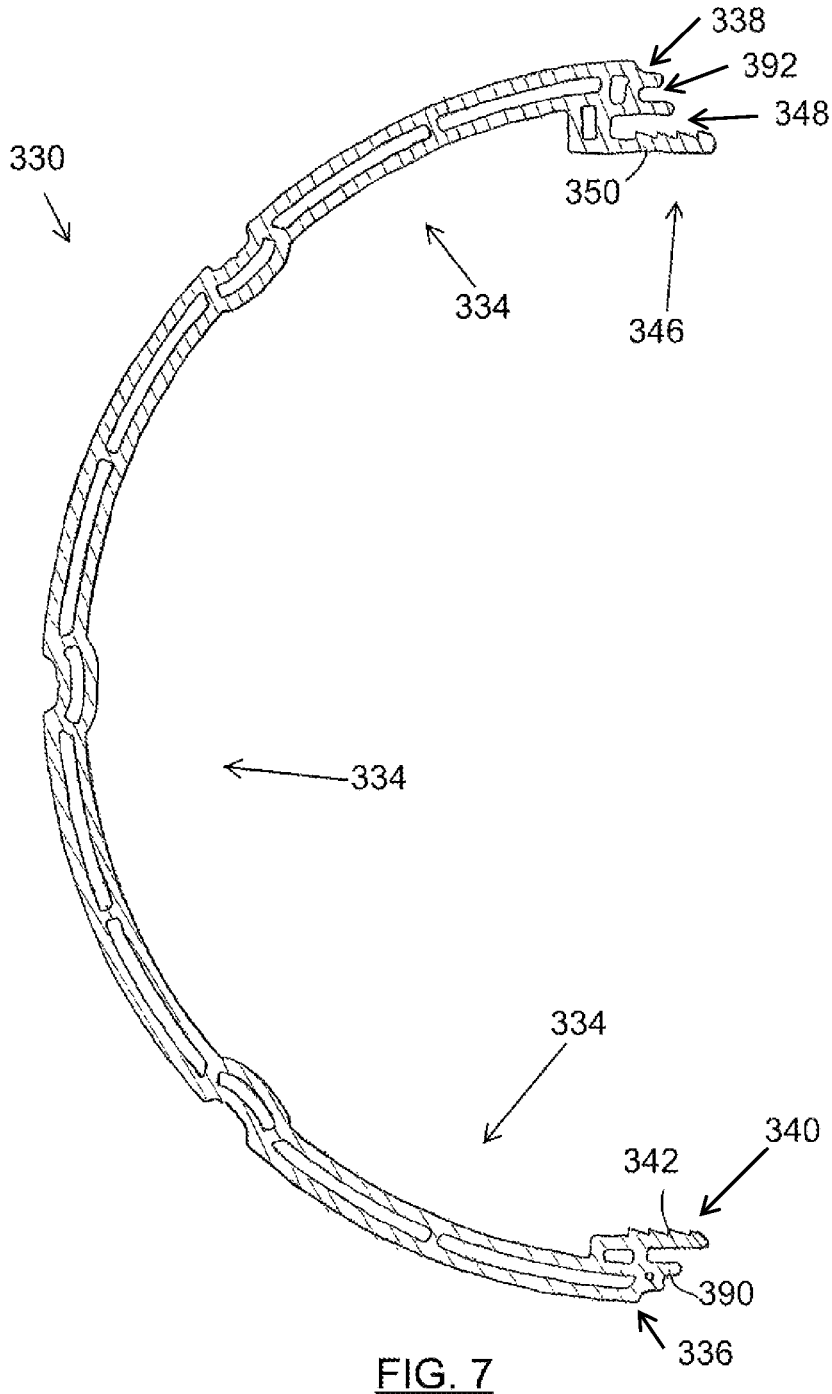
FIG. 7 is an end view of an alternative example of a casing member.
Figure 8:
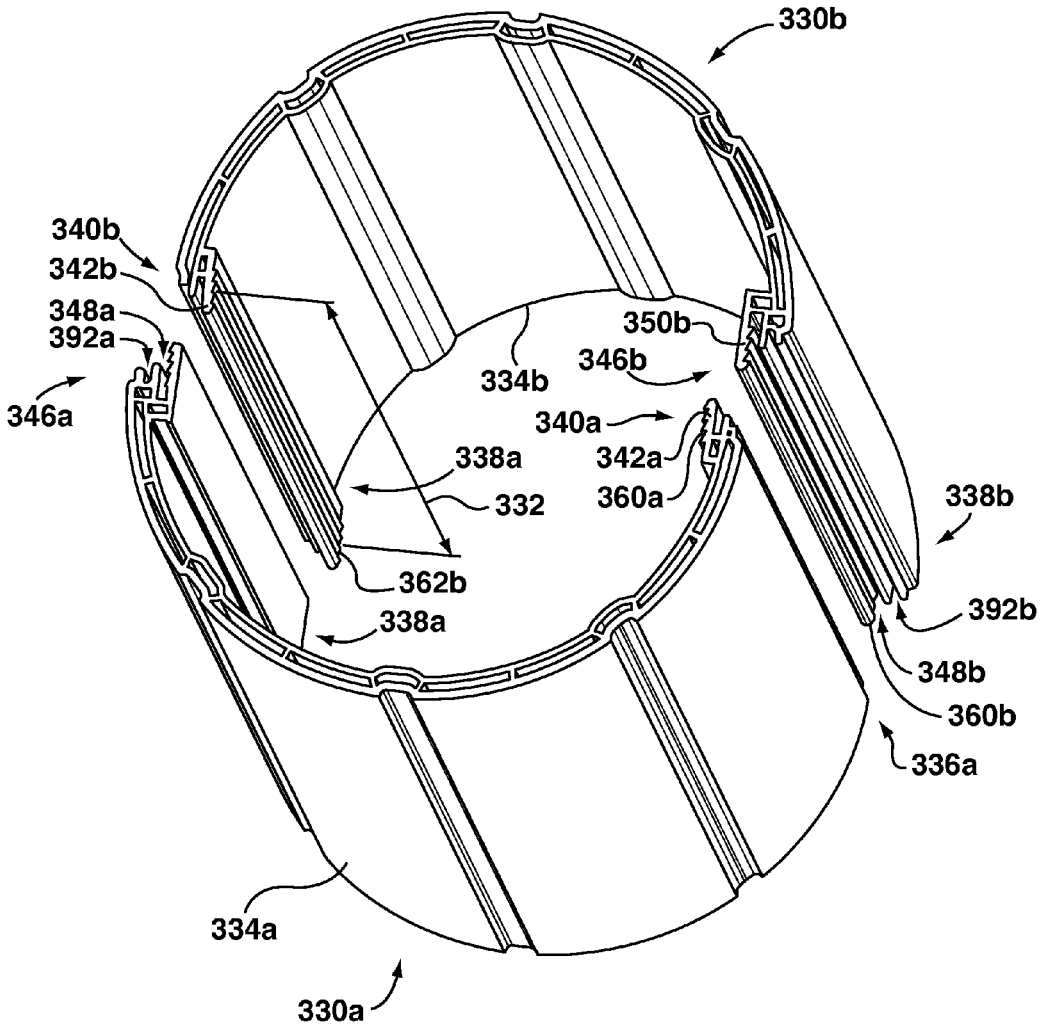
FIG. 8 is a perspective exploded view of two of the casing members of FIG. 7 shown in opposed relation for encasing a post.

Referring now to FIGS. 7 and 8, another example of a casing member 330 for generally encasing a post is illustrated. The casing member 330 is similar to the casing 130, and similar features are identified by like references numerals, incremented by 200.

Each casing member 330 includes an elongate body portion 334 extending along a casing length 332 and having spaced apart first and second side edges 336, 338 extending lengthwise of the body portion 334. Each casing member 330 also includes a first connector 340 extending along and adjacent to the first side edge 336, and the first connector 340 includes a first tongue 342. Each casing member 330 also includes a second connector 346 extending along and adjacent to the second side edge 338, and the second connector 346 includes a first groove 348. The first tongue 342 of one casing member 330 (e.g. tongue 342*a* of casing member 330*a*) is inter-engageable with the first groove of the opposed casing member (e.g. first groove 348*b* of the second casing member 330*b*), and vice versa, so as to secure the two casing members together about the post. In the example illustrated, the grooves 348 include barbs 360, and the tongues 342 include corresponding catches 362.

In the example illustrated, the body portion 334 of the casing member 330 is generally semi-circular in cross-section (as opposed to being L-shaped in cross-section). The body portion 334 extends laterally along a semi-circular path (as viewed in cross-section) between the first and second side edges 336, 338.

While the above description provides examples of one or more processes or apparatuses, it will be appreciated that other processes or apparatuses may be within the scope of the accompanying claims.

The invention claimed is:

1. A casing member for assembly with an opposed identical casing member to encase a post, the casing member comprising:

a) an elongate body portion having a first side edge and a second side edge spaced apart from the first side edge, each side edge extending lengthwise of the body portion;

b) a first connector adjacent the first side edge of the body portion and extending lengthwise therealong, the first connector including a first tongue protruding from the body portion along a tongue axis; and c) a second connector adjacent the second side edge of the body portion and extending lengthwise therealong, the second connector including a first groove bounded at least partially by spaced apart first groove first and second sidewalls joined to the body portion, the first groove having a groove axis parallel to the groove sidewalls;

wherein the tongue axis and the groove axis are parallel to each other, the first tongue inter-engagable with the first groove of the opposed identical casing member and the first groove inter-engageable with the first tongue of the opposed casing member to secure the two casing members together about the post, wherein the casing member has a generally constant cross-sectional profile along its length, and wherein the body portion, the first connector, and the second connector are collectively of integral, unitary, extruded construction.

2. The casing member of claim 1, wherein the first groove first sidewall has a base end and a free end spaced apart from the base end, the first groove first sidewall further comprising at least one barb directed towards the first groove second sidewall, and wherein the first tongue has at least one catch for interlocking with the barb of the opposed casing member when the two casing members are secured together.

3. The casing member of claim 2, wherein the first groove first sidewall is resiliently bendable about the base end to deflect away from the first groove second sidewall when the catch is urged past the barb.

4. The casing member of claim 3, wherein the first groove first sidewall is positioned laterally inwardly of the first groove second sidewall.

5. The casing member of claim 1, wherein the body portion comprises an inner body wall and an outer body wall overlying and spaced apart from the inner body wall, each of the inner and outer body walls extending laterally between the first and second connectors, the inner body wall and outer body wall joined together by a plurality of spaced apart webs.

6. The casing member of claim 1, wherein the first connector comprises a second tongue parallel to and adjacent the first tongue, and the second connector comprises a second groove parallel to and adjacent the first groove, the second tongue inter-engagable with the second groove of the opposed casing member and the second groove inter-engageable with the second tongue of the opposed casing member.

7. The casing member of claim 6, wherein the second groove is positioned laterally outboard of the first groove, and the second tongue is positioned laterally outboard of the first tongue.

8. The casing member of claim 1, wherein the body portion is generally L-shaped in cross-section, having a first planar panel and a second planar panel connected together along a longitudinally extending corner joint.

9. The casing member of claim 1, wherein the body portion is generally semi-circular in cross-section, the two casing members forming a generally cylindrical outer surface when assembled together to encase the post.

10. A column assembly, comprising:

a) a post having a lower post end for bearing against a support surface, an upper post end for bearing against a load surface, and a post length extending between the upper and lower post ends;

b) a first elongate casing member adjacent a first side of the post and extending along the post length; and c) a second elongate casing member adjacent a second side of the post generally opposite the first side, the second elongate casing member extending along the post length and joined to the first casing member to generally encase the post;

each casing member having a first connector that extends lengthwise along a first side of each casing member and that comprises at least a first tongue, and each casing member having a second connector that extends lengthwise along a second side of each casing member and that comprises at least a first groove;

the first tongue of the first casing member inter-engaged with the first groove of the second casing member and the first tongue of the second casing member inter-engaged with the first groove of the first casing member to securely join together the first and second casing members, wherein each of the first and second casing members are formed of respective, generally identical, first and second extruded lineals, the first tongue and first groove being an integral, unitary portion of each one of the first and second extruded lineals.

11. The column assembly of claim 10, further comprising an upper mount adjacent the upper post end for fixing the position of the first and second casing members relative to the load surface.

12. The column assembly of claim 10, wherein the assembly is free of any attachment between the casing members and the post along the post length between the lower post end and the upper post end.

13. The column assembly of claim 10, wherein each casing member comprises an inner surface extending laterally between the first and second sides of the casing member and longitudinally between the lower post end and the upper post end, the inner surface directed towards the post, and where generally the entire inner surface of each casing member is spaced apart from an outer surface of the post.

14. A kit of parts for encasing a post, the kit of parts comprising:

a) a first elongate casing member; and b) a second elongate casing member for assembly with the first casing member to generally encase the post;

the first and second casing members being substantially identical, each casing member having a first connector that extends lengthwise along a first side of each casing member and that comprises at least a first tongue, and each casing member having a second connector that extends lengthwise along a second side of each casing member and that comprises at least a first groove;

the first tongue of the first casing member inter-engageable with the first groove of the second casing member and the first tongue of the second casing member inter-engageable with the first groove of the first casing member to securely join together the first and second casing members, wherein the body portion, the first connector, and the second connector of each casing member are collectively of integral, unitary, extruded construction.

15. The kit of parts of claim 14, wherein the body portion of each casing member comprises an inner body wall and an outer body wall overlying and spaced apart from the inner body wall, each of the inner and outer body walls extending between the first and second connectors, the inner body wall and outer body wall joined together by a plurality of spaced apart webs.

16. The kit of parts of claim 14, wherein the first connector of each casing member comprises a second tongue disposed laterally outboard of the first tongue, and the second connector of each casing member comprises a second groove disposed laterally outboard of the first groove, the second tongue and the second groove parallel to the first tongue and the first groove, wherein engagement of the tongue with the second groove inhibits access to the first tongue and the first groove.

* * * * *